US005496202A

United States Patent [19]

Pons

[11] Patent Number: 5,496,202

[45] Date of Patent: Mar. 5, 1996

[54] FLYING GLIDER SYSTEM

[76] Inventor: Daniel L. Pons, 180 S. 1000 West, Provo, Utah 84601

[21] Appl. No.: 228,040

[22] Filed: Apr. 15, 1994

[51] Int. Cl.[6] ..... A63H 27/14; A63H 27/00

[52] U.S. Cl. ..... 446/64; 446/68

[58] Field of Search ..... 446/61, 62, 63, 446/64, 65, 66, 67, 68, 34; 124/17, 20.1; 244/91, 93, 155 A

[56] References Cited

U.S. PATENT DOCUMENTS

| | | | |
|---|---|---|---|
| 1,157,636 | 10/1915 | Ogrissek et al. | 244/91 |
| 1,675,970 | 7/1928 | Calvo | 446/64 |
| 3,293,793 | 12/1966 | Thomas, Jr. | 446/65 |
| 3,591,975 | 7/1971 | Terc | 446/225 |
| 4,235,040 | 11/1980 | Trowbridge | 446/68 |
| 4,642,062 | 2/1987 | Dorffler | 446/68 |
| 4,997,401 | 3/1991 | Rose et al. | 446/64 |
| 5,240,448 | 8/1993 | Ishikawa | 446/64 |
| 5,364,299 | 11/1994 | Hill et al. | 446/61 X |

FOREIGN PATENT DOCUMENTS

| | | | |
|---|---|---|---|
| 1444626 | 8/1976 | United Kingdom | 446/64 |
| 1578956 | 11/1980 | United Kingdom | 244/91 |

*Primary Examiner*—Robert A. Hafer
*Assistant Examiner*—D. Neal Muir

[57] ABSTRACT

A toy flying glider system in which a toy flying glider is provided with a flat body including a nose section, a central body section with oppositely extending wings, each having spaced apart fins extending top and bottom, a tail section and a hook secured by a folded central body stiffener and a hand held launcher providing better gripping by a user and protection of vulnerable parts of the user's hand during launching.

7 Claims, 2 Drawing Sheets

FLYING GLIDER SYSTEM

BACKGROUND OF THE INVENTION

1. Field of the Invention

This invention relates to a flying glider system including a toy glider aircraft and a launcher for the aircraft.

2. Prior Art

Flying toy gliders have long been known and are popular. Such gliders have been made from different materials, such as paper, cardboard, balsam wood and plastic. In general, the toy gliders have had a body section, with a nose, wings and a tail structure. Some, made of plastic have had a circular or disk shaped body and frequently they include a weighted nose. The toy gliders also often include a tail section with one or more fins or rudders and a gripping area to be used to hold the glider as it is launched into flight. The known gliders may be launched into flight by throwing or by various types of launching devices. One of the most common of the launching devices used is merely a stick with a rubber band connected to one end. The stick is held in one hand and is raised skyward, the rubber band is connected to a hook on the glider and the tail section of the glider is grasped and is pulled to stretch the rubber band. When the tail section is released the resiliency of the rubber band generally propels the glider into flight. However, it is not uncommon that when the glider is released, it hits the launcher stick or the hand holding the stick and crashes.

OBJECTS OF THE INVENTION

Principle objects of the present invention are to provide a flying toy glider and launcher system wherein a glider and a launcher can be constructed and marketed inexpensively and can be used without the glider hitting the hand of a user when the glider is launched.

Other objects are to provide a glider that can be easily assembled by a user and, that when assembled has very good and easily varied flight characteristics.

FEATURES OF THE INVENTION

Principle features of the glider invention include that it is constructed of readily formed and easily assembled plastic components; that it includes spaced apart double fins projecting both above and below a flat body section; a nose section including a rubberized nose piece attached at a fold of a central body stiffener that serves as a top rib and as a composite bottom rib and launch hook lock.

Aligned holes through the top rib, bottom rib and body section provide a finger tip gripping point. Flat spacers affixed to the top and bottom of the body section, between the fins of each pair of fins maintain fin spacing.

Additional objects and features of the invention will become apparent from the drawings and detailed description to those persons skilled in the art to which the invention pertains.

THE DRAWINGS

In the drawings:

FIG. 1, is a perspective view of the glider of the invention, taken from above and to one side, at the front of the aircraft;

FIG. 2, a perspective view of the launcher of the invention, taken from the front and above one side of the launcher; and FIG. 3, a perspective view of the glider of the invention connected to a launcher of the invention and with a user's hand grasping the launcher.

DETAILED DESCRIPTION

Figure 1:
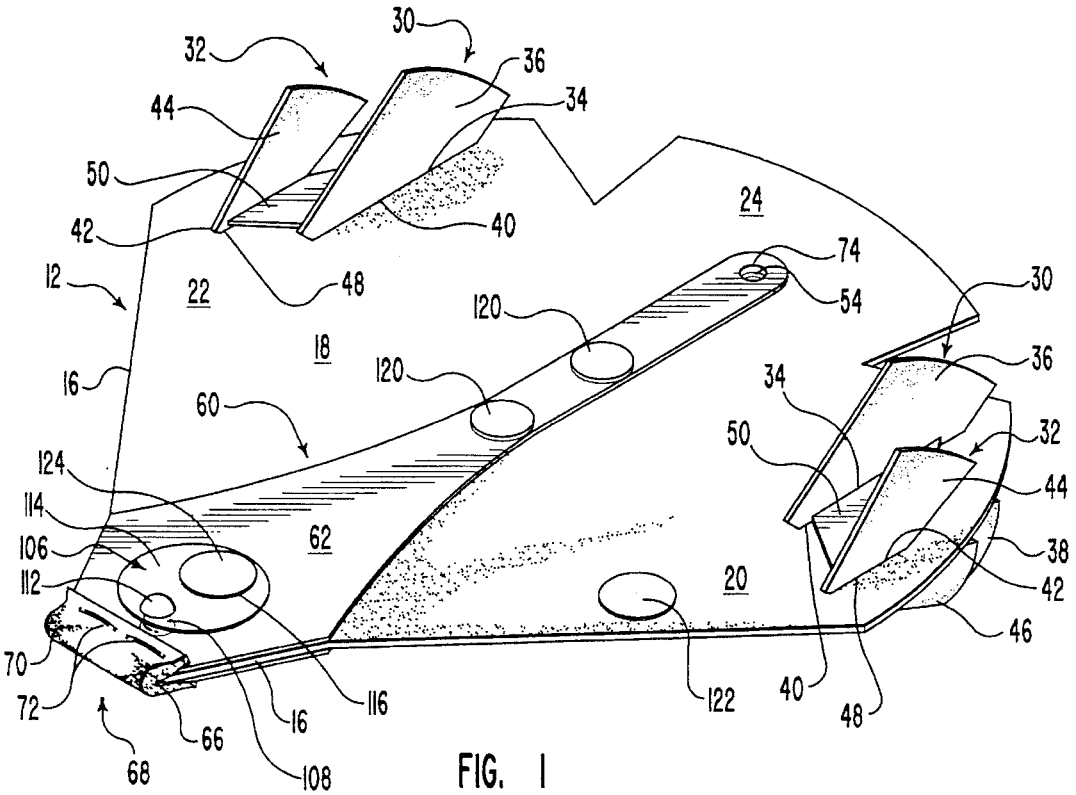
Figure 2:
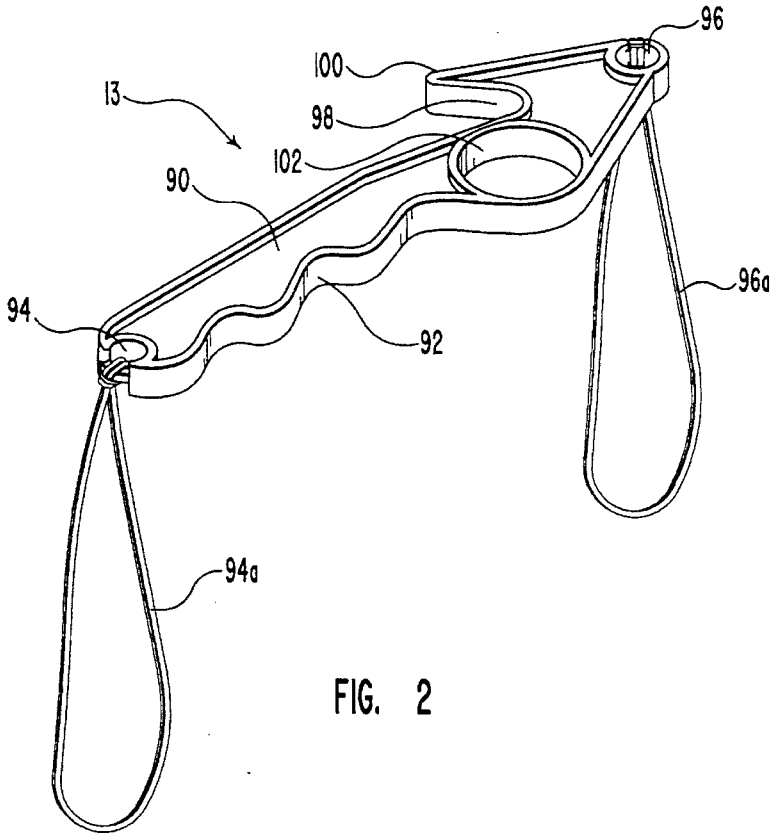
Figure 3:
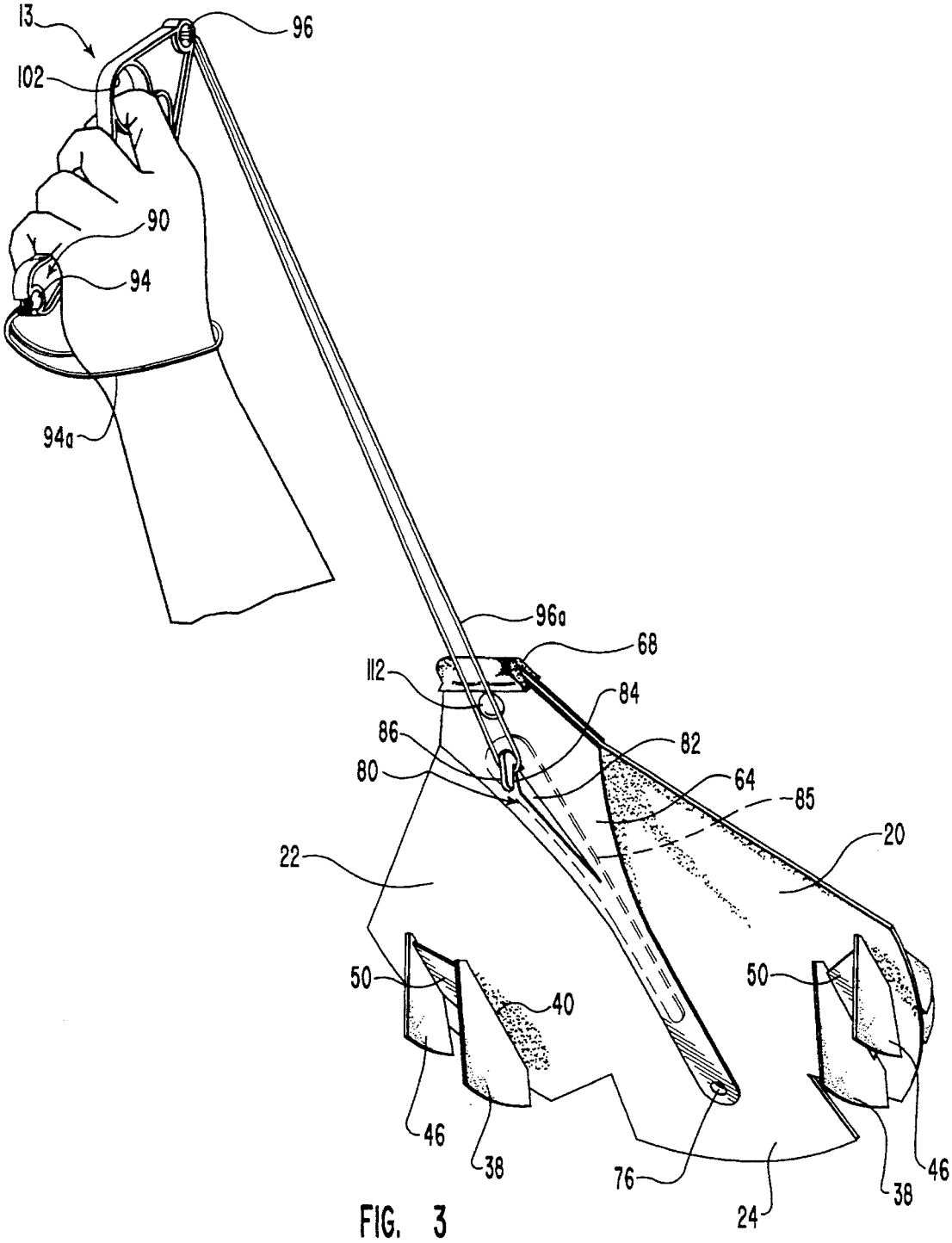

Referring to the drawings:

In the illustrated preferred embodiment the flying glider system 10 includes a glider 12 and a launcher 13. Glider 12 includes a one-piece flat body 14 shaped to have a nose section 16; a central body section 18 forming a continuation of the nose section; a pair of oppositely disposed wings 20 and 22 projection from opposited sides of the central body section; and a tail section 24, forming a rear continuation of the central body section.

The one-piece flat body 14 is preferably formed from a sheet of flat styrofoam material. Large tail fins 30 and small tail fins 32 are also made of flat, lightweight sheet material. Preferably, the tail fins are each die-cut from the same sheet of styrofoam material used to form the body 14.

The tail fins are each of generally heart shape, with the length 34 between the intersection of lobes 36 and 38 of the large tail fins 30 being the same as the length of a long slot 40 in each wing 20 and 22. Similarly, the length 42 between lobes 44 and 46 of each small fin 32 is the same as the length of a shorter slot 48 through each wing 20 and 22.

Parallel slots 40 and 48 are provided in each wing 20 and 22, with a tail fin spacer 50 positioned on top and bottom surfaces of the body 14, between the slots in each wing.

A flat central body stiffener 60 having a top rib 62 is connected to a bottom rib 64 by a fold 66. The fold 66 is wrapped aroung the nose 16 and is secured by a resilient nosepiece 68 that is wrapped around the fold 66 at 70. Staples 72 through the nose piece 68, top rib 62, nose 16 and bottom rib 64 hold the nosepiece to the body stiffener 60 and nose 16. Nosepiece 68 also serves as a weight at the nose of the glider 12.

A hook unit 80 has a hook support member 82 with a hook 84 theron projecting from a flat backing member 85 positioned between the bottom rib 64 and the bottom of body section 18, through a slot 86 in the bottom rib 64. The flat backing member 85 extends nearly the full length of the bottom rib 64. Hook 84 is angled rearwardly from the nose 16 to have a rubber band **96*a* (or the like) hooked thereover. The hook unit 80 provides balance to the glider as well as providing means for attachment of the rubber band 96*a***.

The top and bottom ribs 62 and 64, respectively of the central body stiffener 60 are bonded to the flat body 14 and the bottom rib 64 is also bonded to the hook unit 80, which, in turn, is also bonded to the body 14.

Launcher 13 includes a handle 90, with finger indentations 92 forming a front edge and a hole 94 to have a resilient wrist strap **94*a* looped therethrough. Another hole 96 is formed in opposite end of handle 90 to have the rubber band 96*a* looped therethrough. Handle 90 also has a thumb notch 98 with an overhang 100 to protect the thumb of a user during launch of the glider 12. Another hole 102** is provided in the launcher handle to receive the forefinger of a user.

In use, a user places a hand through the wrist strap **94*a* and grasps the handle 90 with a forefinger through hole 102 and the remaining fingers around indentations 92. The end of the thumb is positioned in notch 98, such that overhang 100 extends over the thumb to serve as a shield that will protect the thumb from being hit by a released glider or the rubber band 96*a*. Rubber band 96*a* is hooked over hook 84 and with a thumb and forefinger respectively of the other hand engaging holes 74 and 76 through the central body stiffener the launcher is pulled out, the glider is pulled back to stretch the rubber band 96***a* and the glider is released to be propelled by the resiliency of the rubber band.

Tail section 24 may be pinched up or down to provide desired trim when the glider is in flight.

An adjustable weight system 106 is provided to fine tune the balance of the glider. The weight system includes a plastic rivet 108 extending through the top and bottom ribs 62 and 64 and flat body 14, with a head 112 on each end of the rivet. A disc 114 of thin vinyl material having a coating of self-adhering material on one side 116 is eccentrically mounted to pivot on the rivet 108, with the side 116 against the top rib 62. It will be apparent that a similar disc could be eccentrically mounted on the rivet 108 and against the rib 64, either in place of the disc 114, or, in addition thereto. In practice, the glider is launched into flight with the eccentrically mounted disc rotated to different positions with respect to the rivet. When a desired flight pattern is achieved the disc 114 is pressed tightly against the rib 62 to be bonded in place. Other pre-formed discs 120, having a self-adhering surface may be placed on the ribs 62 or 64 as needed to change or correct a flight pattern. Such pre-formed discs may also be attached to other glider areas, as shown at 122. In addition, as shown at 124, one or more discs may be affixed to the eccentrically mounted disc 114 to more drastically change the balance as the eccentrically mounted disc is pivoted about rivet 108. The discs 114, 120, 122 and 124 counterbalance any overbalance that may result from the body stiffener 60 or nosepiece 68 and will allow the user to counter adverse effects of changing atmospheric conditions. The discs also provide an easy means for changing the flight pattern of the glider, should the user so desire.

While a presently preferred embodiment of the invention has been herein disclosed, it is to be understood that variations are possible without departing from the scope of the following claims, which define the invention.

What is claimed is:

1. A toy flying glider system comprising a launcher having an elongate handle with a rubber ban affixed to one end thereof and having a notch to receive a thumb and an overhang turned back along and spaced from said handle to protect the thumb at said end to which said rubber band is affixed; and a glider comprising a flat body with a nose section, a central body section extending from said nose section, oppositely disposed wing sections at opposite sides of said body section and a tail section extending from said body section; a hook projecting from said flat body to engage said rubber band, and two spaced apart pair of fins, with one pair of fins extending above and below one of said wings and the other pair of said fins extending above and below the other of said wings, and an flat tail fin spacer extending between each pair of fins extending above the wings and another flat tail fin spacer extending between each pair of fins beneath the wings, said tail fin spacers each being affixed to said wings.

2. A toy flying glider system as in claim 1, wherein said launcher handle has a hole therein to receive a forefinger of a user and indentations in a leading edge thereof to receive the other fingers of a user.

3. A toy flying glider system as in claim 2, wherein said glider further includes a flat body stiffener folded across said nose section to provide a central top rib extending substantially from a front to a rear of said flat body affixed to a top surface of said flat body and a central flat bottom rib extending substantially from the front to the rear of said flat body, affixed to a bottom surface of said flat body and opposed holes in said top rib and said bottom rib at the ends of said ribs opposite the fold across said nose section, said holes being aligned with a hole aligned centrally and extending through the body section to provide finger and thumb gripping means for a user of said glider.

4. A toy flying system as in claim 3, further including weight means attached to said flat body to change the flight characteristics of said glider, said weight means including a rivet extending through said flat body and said top and bottom rivets and having an enlarged head at each end of said rivet, a disc of flat, thin sheet material eccentrically mounted on said rivet and pivotable about said rivet, and means for releasably securing said disc in an assigned eccentric position relative to said rivet.

5. A toy flying glider as in claim 4, wherein said weight means includes at least one other disc, of flat, plastic sheet material bonded to the disc eccentrically mounted on the rivet.

6. A toy flying glider system comprising a launcher having a handle with a rubber band affixed to one end thereof and having a handle with a rubber band affixed to one end thereof, a notch to receive a thumb and an overhang to protect the thumb at said one end; and a glider comprising a flat body with a nose section, a central body section extending from the nose section, oppositely disposed wing sections at opposite sides of said body section and a tail section extending from said body section, a hook projecting from said flat body section to engage said rubber band, and a pair of spaced apart fins, with each fin extending above and below one of said wing sections, and weight means attached to said flat body to change the flight characteristics of the glider, said weight means including a rivet extending through said flat body and having an enlarged head at each end of said rivet, a disc of flat, thin sheet material eccentrically mounted on said rivet and pivotable about said rivet, means for affixing said disc relative to said rivet, and at least one other disc of flat sheet material bonded to said disc eccentrically mounted on said rivet

7. A toy flying glider system comprising a launcher having a handle with a rubber band affixed to one end thereof and having a notch to receive a thumb an an overhang to protect the thumb at said end, said launcher handle having a hole therein to receive a forefinger of a user and indentations in a leading edge thereof to receive the other fingers of a user; and a glider comprising a flat body with a nose section, a central body section extending from said nose section, oppositely disposed wing sections at opposite sides of said body section and a tail section extending from said body section, a hook projecting from said flat body section to engage said rubber band, and a pair of spaced apart fins, with each fin extending above and below each of said wings, a flat body stiffener folded across said nose section to provide a central top rib affixed to a top surface of said flat body and a central flat bottom stiffener affixed to a bottom surface of said flat body, said top rib and said bottom rib each having a hole through the end thereof remote from said nose section and aligned with a hole through said flat body, a resilient nosepiece folded over the fold in said flat body stiffener and secured by means extending through said nosepiece, to said flat body and said flat body stiffener, weight means attached to said flat body to change the flight characteristics of said glider, said weight means including a plastic rivet extending through said top and bottom ribs and having an enlarged head at each end of said rivet, a disc of flat, this sheet material eccentrically mounted on said rivet and pivotal about said rivet, and means for affixing the disc to a said rib and relative to said rivet, at least one disc of flat sheet material bonded to a portion of said glider, and at least one other disc of flat sheet material bonded to said disc eccentrically mounted on said rivet.

* * * * *